US005890636A

United States Patent [19]

Kibbe

[11] Patent Number: 5,890,636

[45] Date of Patent: Apr. 6, 1999

[54] BEVERAGE DISPENSING SYSTEM

[76] Inventor: Andrea J. Kibbe, 2645 Harvest La., Forth Worth, Tex. 76133-5877

[21] Appl. No.: 908,316

[22] Filed: Aug. 7, 1997

Related U.S. Application Data

[60] Provisional application No. 60/023,723, Aug. 8, 1996.

[51] Int. Cl. [6] ..... A45F 5/00

[52] U.S. Cl. ..... 224/148.6; 224/148.4; 224/222; 224/245; 224/267; 224/901.8

[58] Field of Search ..... 224/101, 148.1–148.7, 224/219, 220, 221, 222, 242, 245, 267, 191, 901, 901.2, 901.4, 901.6, 901.8

[56] References Cited

U.S. PATENT DOCUMENTS

| | | | |
|---|---|---|---|
| 3,372,846 | 3/1968 | Berkus . | |
| 3,618,829 | 11/1971 | Elmore et al. . | |
| 4,428,507 | 1/1984 | Sneider . | |
| 4,428,508 | 1/1984 | Gardikas et al. . | |
| 4,448,316 | 5/1984 | Hiroshige . | |
| 4,557,401 | 12/1985 | Hodge . | |
| 4,564,957 | 1/1986 | Scharf | 224/148.6 |
| 4,700,861 | 10/1987 | Neward . | |
| 4,913,326 | 4/1990 | Echelson | 224/222 |
| 4,974,762 | 12/1990 | Boretsky et al. | 224/148.6 |
| 4,976,364 | 12/1990 | Solomon . | |
| 5,048,705 | 9/1991 | Lynd et al. . | |
| 5,060,835 | 10/1991 | Payne | 224/148.6 |
| 5,240,156 | 8/1993 | Sicotte et al. | 224/148.5 |
| 5,395,023 | 3/1995 | Naymark et al. | 224/245 |
| 5,566,869 | 10/1996 | Katz | 224/148.2 |
| 5,573,153 | 11/1996 | Stillman | 224/148.4 X |

FOREIGN PATENT DOCUMENTS

| | | |
|---|---|---|
| 3047185 | 7/1982 | Germany . |
| 152594 | 12/1955 | Sweden . |

*Primary Examiner*—Allan N. Shoap
*Assistant Examiner*—Gregory M. Vidovich
*Attorney, Agent, or Firm*—Richard C. Litman

[57] ABSTRACT

A beverage dispensing system is disclosed for use during recreational activities. The beverage dispensing system includes a container and a holding element which is used to retain the container and secure it to the person. The beverage container is made of a lightweight, squeezable, durable material having either a spray, nozzle, tubestraw, pump, or poppet valve. The beverage dispensing system may include fasteners useful in securing the container to the holding element. The holding element can be made of a durable, lightweight material and includes a pocket or functionally similar attachment dimensioned and configured to receive the container. In practice, the user secures the holding element onto the appropriate body part (e.g. forearm) and then places the container, filled with an appropriate quantity of a beverage, into the pocket. The container is now within easy reach of the user, and outdoor exercises may be easily performed.

4 Claims, 6 Drawing Sheets

BEVERAGE DISPENSING SYSTEM

CROSS-REFERENCE TO RELATED APPLICATION

This application claims the benefit of U.S. Provisional Patent Application Serial No. 60/023,723, filed Aug. 8, 1996.

BACKGROUND OF THE INVENTION

1. Field of the Invention

The present invention relates generally to beverage dispensing and transporting devices and more particularly to a beverage dispensing system for use during exercising and sporting activities.

2. Description of the Related Art

Each year the number of people engaging in strenuous outdoor exercising or sporting activities increases. More and more people are concerned about staying fit, strengthening their heart, losing weight or simply enjoying the weather by playing sports. Most of those who exercise prefer to either walk, jog, rollerblade, or ride bicycles. Others prefer sporting activities such as tennis, basketball, soccer, volleyball, softball, etc. Regardless of the selected exercise or sport, the greatest amount of outdoor activity occurs during the summer months. Associated with the beautiful, clear blue skies of summer is the fluid-draining heat. To combat the effects of the heat, many people carry water bottles with them while they exercise. Unfortunately, it can be very difficult to carry water bottles while exercising. This is true especially for joggers because they must either carry the water bottle in their hands or hang it from their bodies. If carried by hand, the bottles become a hinderance and if hanging from the body, the bottles tend to bounce around. Either way, the bottles are a nuisance to the users.

Joggers and other sports enthusiasts worldwide would greatly appreciate a device that allows them to conveniently and easily carry their water bottles with them while exercising. An added plus would be a device that does not add an undue burden to them. There is, therefore, a need for a device that would allow people conveniently and easily to carry bottles containing water or other beverages while exercising, would not be a hinderance to their exercising, would be lightweight, and would not obstruct their range of motion during their exercise or sports activities, primarily allowing free use of both hands. The present invention provides such a device.

Water bottles and carrying cases have been described in related patent literature. For example, U.S. Pat. No. 3,372,846 issued on Aug. 29, 1966 to Berkus discloses a pouring spout for a plastic container. The spout assembly includes a vent valve in order to provide a sealing enclosure when placed in a retractable position.

U.S. Pat. No. 3,618,829 issued on Nov. 9, 1971 to Elmore discloses an expandable receptacle having an accordion folding in the top portion to allow expansion and compression so as to allow evacuation of the contents of the receptacle through a discharge nozzle.

U.S. Pat. No. 4,428,507 issued on Jan. 31, 1984 to Sneider discloses a collapsible container with accordion pleated sidewalls. The container includes an air vent which is removably mounted to an opening in the top surface of the container. The bottom of the container includes a discharge opening on which a cutoff valve is mounted.

U.S. Pat. No. 4,428,508 issued on Jan. 31, 1984 to Gardikas et al. discloses an athlete's water bottle formed from a resilient, laterally deformable polymerized resin. A closure assembly coupled to the container includes a water dispensing tube projecting outwardly therefrom.

U.S. Pat. No. 4,448,316 issued on May 15, 1984 to Hiroshige discloses a liquid drink container having a straw accommodated such that when the seal cover of the container is removed, one end portion of the straw may spring out of the container by force of a spring acting thereon.

U.S. Pat. No. 4,557,401 issued on Dec. 10, 1985 to Hodge discloses a fluid container safety valve which has a first check valve resiliently held open in response to pressure inside the container. A second check valve is positioned inside the first check valve casing and resiliently held open in response to a negative pressure inside the container to permit fluid flow back into the container.

U.S. Pat. No. 4,700,861 issued on Oct. 20, 1987 to Neward discloses a container lid for liquid transfer having a doubletapered liquid transfer sleeve for providing an air tight seal around a fluid transfer conduit and having an air passage part.

U.S. Pat. No. 4,976,364 issued on Dec. 11, 1990 to Solomon discloses an improved cap and straw assembly for use with a water bottle or the like. The assembly includes a bottle cap of the type having a poppet valve and is equipped with a drinking straw to facilitate dispensing or drinking of a beverage from the bottle.

U.S. Pat. No. 5,048,705 issued on Sep. 17, 1991 to Lynd et al. discloses a bottle and drinking tube assembly for dispensing liquids. The bottle has an open top body formed from a resilient plastic material, and a cap for closing the top. The bottle is further adapted to be collapsed upon application of moderate hand pressure. An aperture is formed in the cap for receiving an elongated drinking tube.

Swedish Patent No. 152,594 issued in July 1954, and German Pat. No. 3,047,185 issued in July 1982, both describe water bottles containing straws for drinking the fluid contained therein.

None of the above inventions and patents, taken either singly or in combination, is seen to describe the instant invention as claimed.

SUMMARY OF THE INVENTION

Accordingly, it is a principal object of the invention to provide a beverage dispensing system capable of being secured to one's person.

It is another object of the invention to provide a beverage dispensing system dimensioned and configured for attachment to the user's limb.

It is an object of the invention to provide improved elements and arrangements thereof in an apparatus for the purposes described which is inexpensive, dependable and fully effective in accomplishing its intended purposes.

In accordance with the objects of the invention, a beverage dispensing system is provided for transportation on one's person. The beverage dispensing system includes a container which is used to store a predetermined quantity of a selected beverage therein, for example, water or juice. A holding element is provided for receiving the container. The holding element is also capable of being attached to various parts of the person's body. The holding element may also be configured for attachment to an article of clothing or other similar apparel. The container includes a cap, or similar sealing means, to facilitate dispensing of the beverage therein. The container may also include a straw for dispensing of the beverage. In preferred embodiments of the invention, means are provided for releasably securing the container within the holding element.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
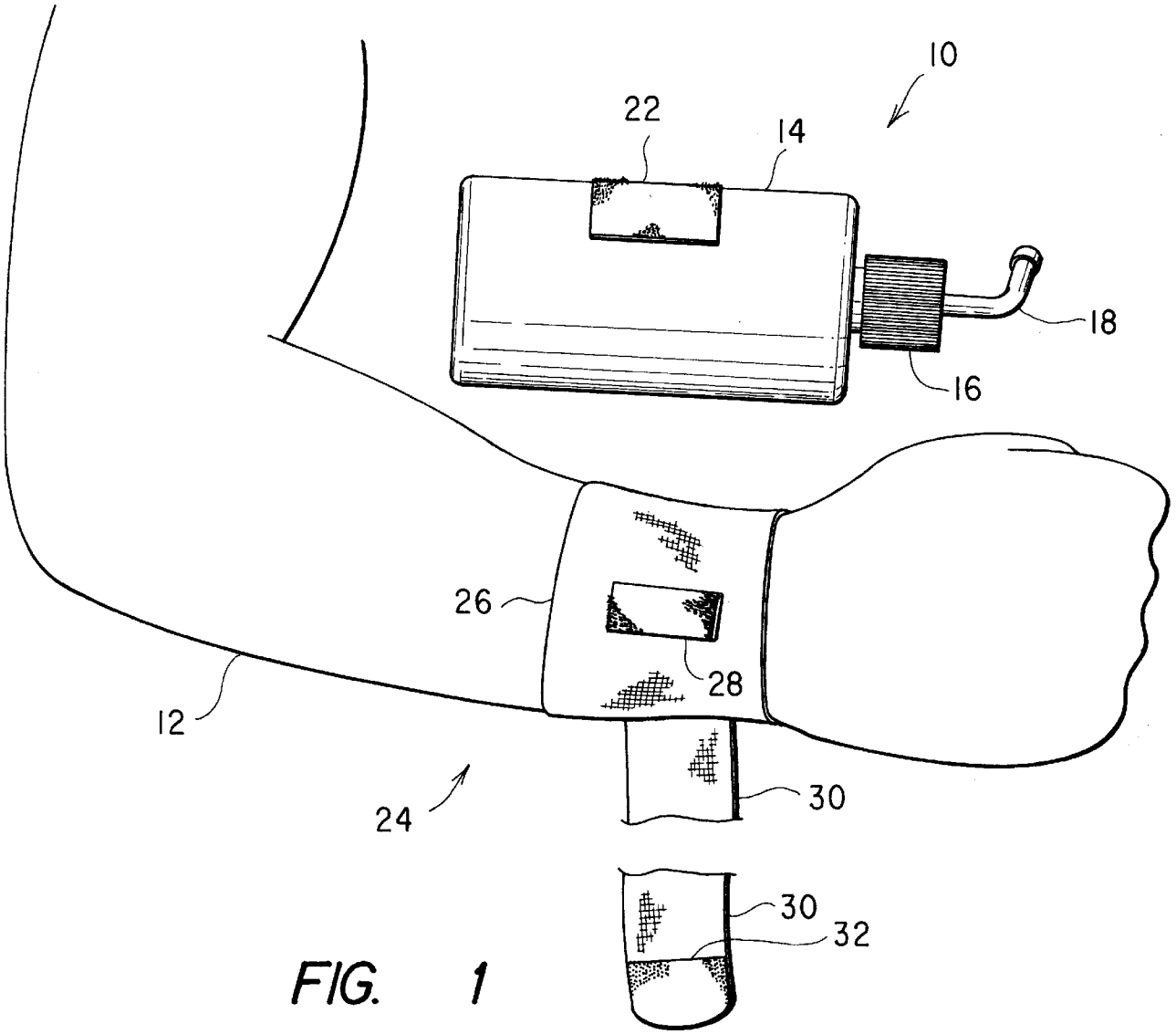
FIG. 1 is a perspective environmental view of a beverage dispensing system in accordance with the present invention.
Figure 2:
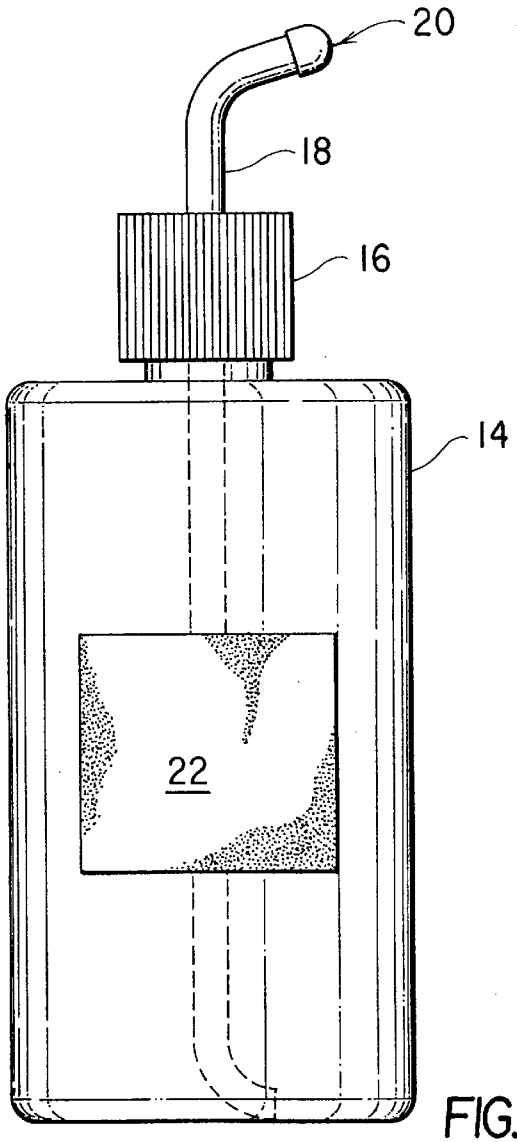
FIG. 2 is a front elevational view of a first embodiment for the beverage container.

Referring now to the drawings and initially to FIGS. 1 and 2, there is shown a beverage dispensing system 10 in accordance with the present invention, which I prefer to call the THIR-MATE (trademark pending) beverage dispenser. The beverage dispensing system 10 is shown attached to a person's arm 12. The beverage dispensing system 10 includes a container 14 and a holding element 24. The container 14 is in the form of bottle which is preferably constructed from lightweight materials. The container 14 includes sealing means such as a twist top 16 for allowing the person to selectively consume and replenish the beverage contained therein. The container may also be provided with a straw 18 for easy consumption of the beverage. As seen in FIG. 2, the straw 18 has a greater length than the container 14. Accordingly, the twist top 16 is is provided with an aperture to allow passage of the straw 18 therethrough. A cap 20 is disposed over the end of the straw 18 to prevent accidental spillage of the beverage.

The holding element 24 includes a band 26 of flexible material which forms a closed loop. The band 26 is appropriately sized for passage of the person's arm 12 therethrough. Furthermore, the band 26 includes a certain level of elasticity to provide a snug and secure fit around the arm 12. A belt 30 is attached to the band 26 in order to retain the container 14. The belt 30 includes corresponding patches 32 of hook and loop type fasteners on its surface and at its terminal end. It should be appreciated that various other types of fasteners may be used with the belt 30 or various other components which use hook and loop type fasteners; for example, clips, pins, buckles, etc. The hook and loop patch on the surface of the belt (not shown) is appropriately positioned such that it is in registry with the corresponding hook and loop patch 32 at the terminal end, after the belt 30 has been wrapped around the container 14, as shown in FIG. 1. Referring to FIG. 2, the container 14 includes a patch 22 of hook and loop fastener on the surface thereof. A corresponding hook and loop patch 28 is disposed on the surface of the band 26. Thus, the container 14 is secured by both the belt 30 and the corresponding hook and loop patches 22, 28.

Figure 3:
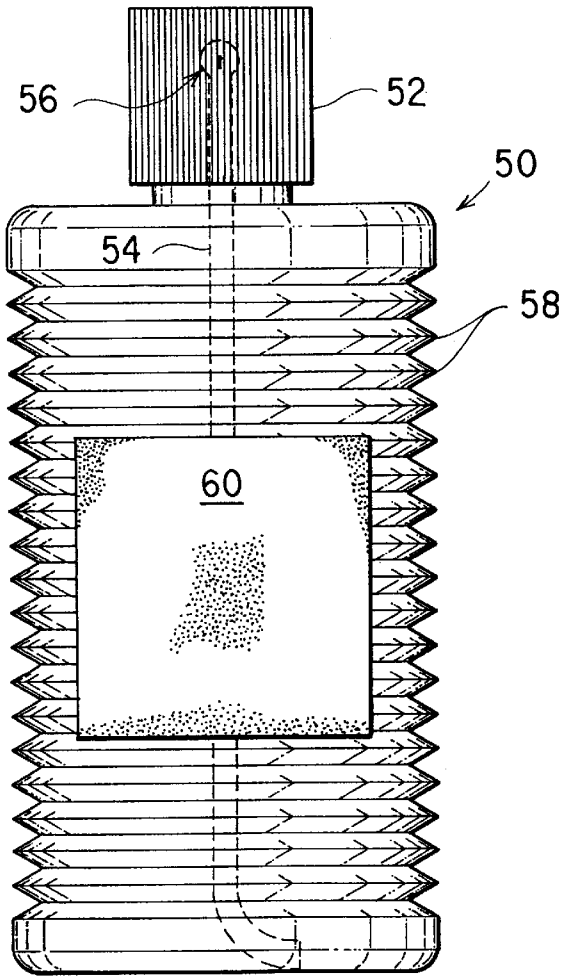
FIG. 3 is a front elevational view of a second embodiment for the beverage container.

FIG. 3 illustrates an alternative embodiment for the beverage container 50. The beverage container 50 is in the form of a bottle which includes a twist top 52 for allowing the person to selectively consume and replenish the beverage contained therein. The container 50 also includes a straw 54 which extends into a bore (not shown) within the twist top 52. An atomizing cap 56 is coupled to the terminal end of the straw 54. The atomizing cap 56 functions to dispense the beverage in the form of a spray, as well as preventing accidental spillage thereof. The container 50 includes a plurality of pleats 58 disposed along its surface. The pleats 58 function in a manner similar to an accordion by allowing the internal volume of the container 50 to be selectively increased or decreased. The container 50 also includes a patch 60 of hook and loop fastener on its surface for engaging the corresponding patch 28 of hook and loop fastener disposed on the band 26.

Figure 4:
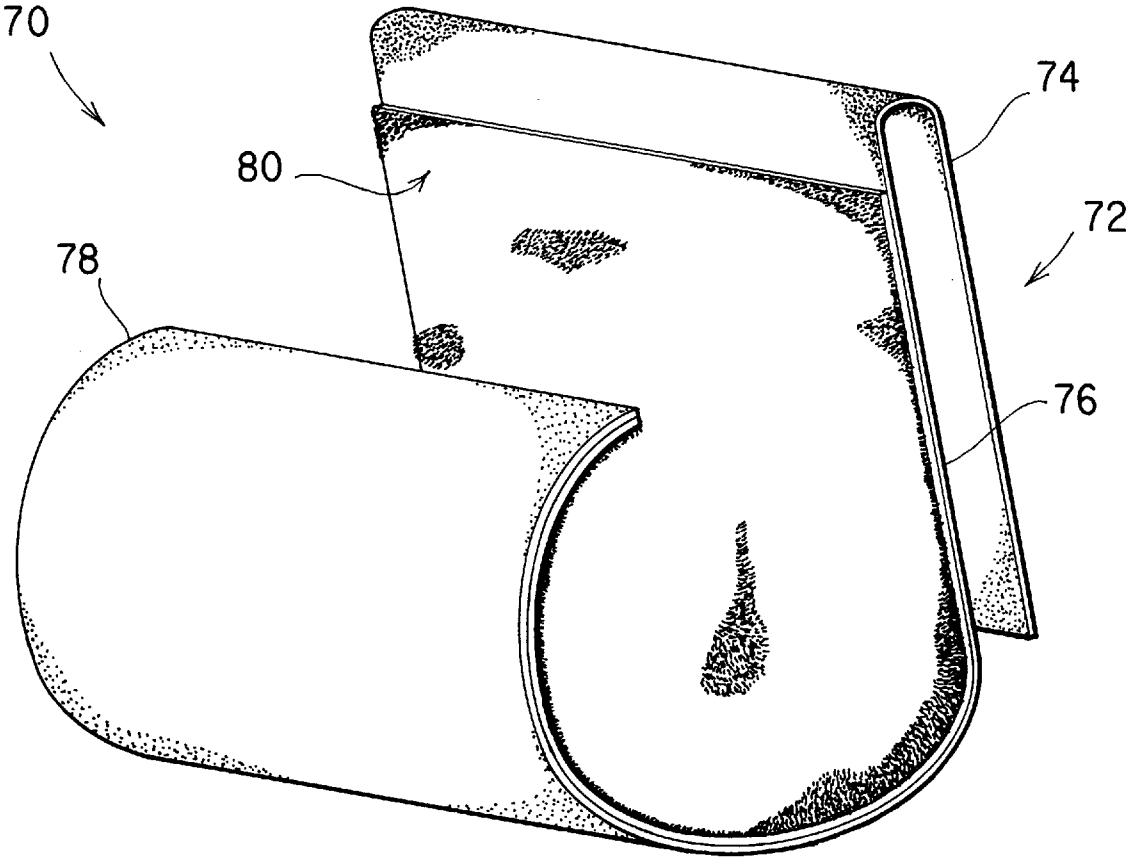
FIG. 4 is a perspective view of a second embodiment for the holding element.

FIG. 4. illustrates a second embodiment for the holding element 70. The holding element 70 includes a clip 72 for attachment to the person's clothing apparel. The clip 72 is generally U-shaped and includes a first leg 74 and a second leg 76. The first and second legs 74, 76 are spaced apart a predetermined distance in order to accommodate articles of clothing such as a belt therebetween. Furthermore, the first and second legs 74, 76 are resiliently biased in order to remain mounted on the article of clothing. A hook portion 78 is integrally formed with the second leg 76. As seen in FIG. 4, the hook portion 78 initially curves away from the clip 72 and continues to curve such that it's terminal end returns toward the second leg 76. The hook portion 78 is used to receive the beverage container 14. The curving nature of the hook portion 78 provides a level of resiliency which has a grabbing effect on the container 14, and holds it in position. In preferred embodiments of the invention, the surface of the hook portion 78 may include a large patch 80 of hook and loop fastener disposed thereon in order to engage the corresponding patch 22 of hook and loop fastener disposed on the container 14.

Figure 5:
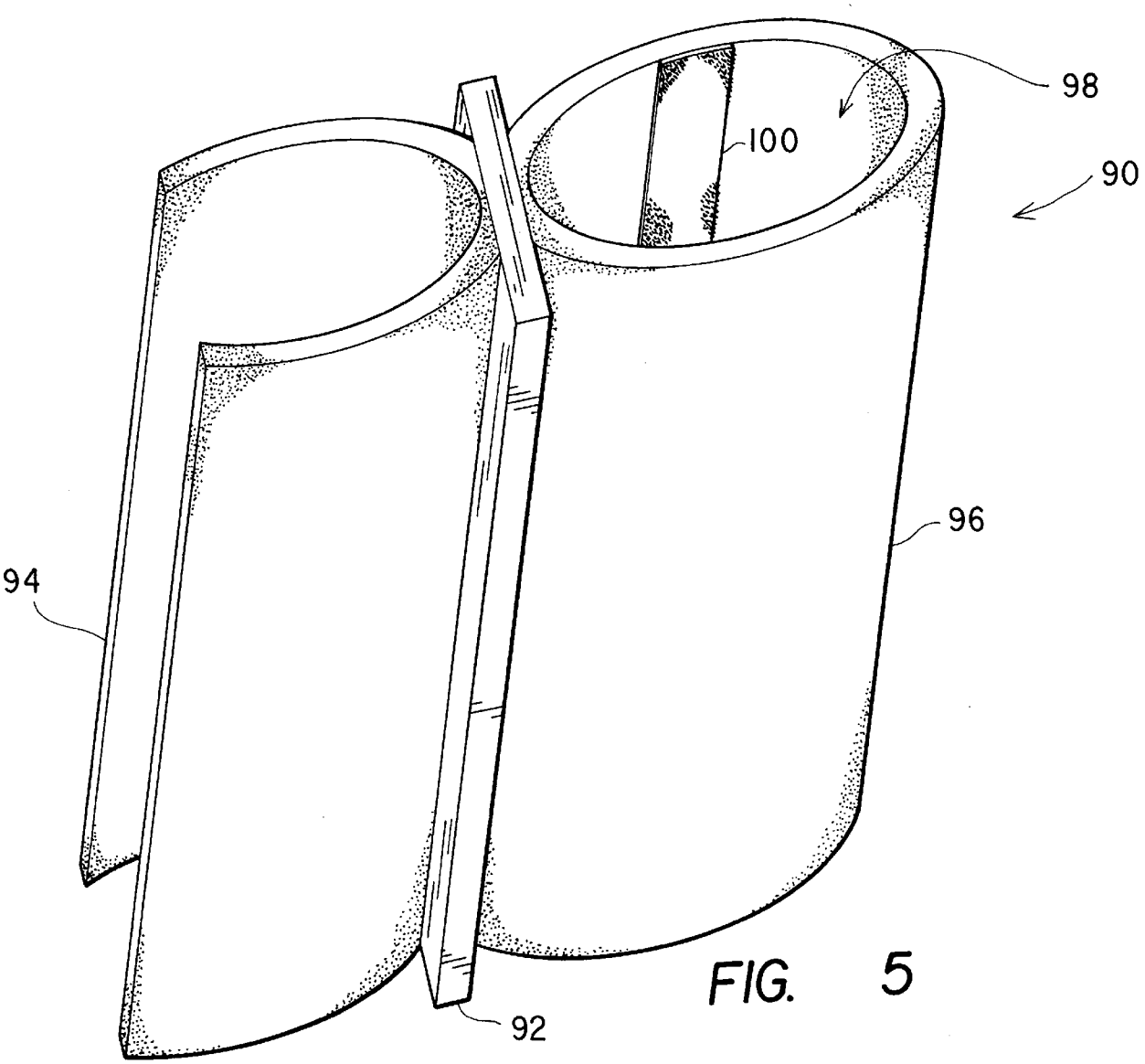
FIG. 5 is a perspective view of a third embodiment for the holding element.

FIG. 5 illustrates a third embodiment of the holding element 90. The holding element 90 includes a base member 92 which is flat and generally rectangular. The base member 92 is preferably designed with a certain level of rigidity. A clamp 94 is coupled to one side of the base member 92. The clamp 94 has a C-shaped cross-section, and is designed to fit firmly around the person's arm. A pocket 96 is secured to the opposite side of the base member 92. The pocket 96 is generally tubular and includes an opening 98 through which the container 14 may be passed. The pocket 96 may be provided with two openings 98 such that the container 14 extends beyond the confines thereof. The pocket 96 may also include a patch 100 of hook and loop fastener on its interior surface to engage the corresponding hook and loop patch 22 disposed on the container 14.

Figure 6:
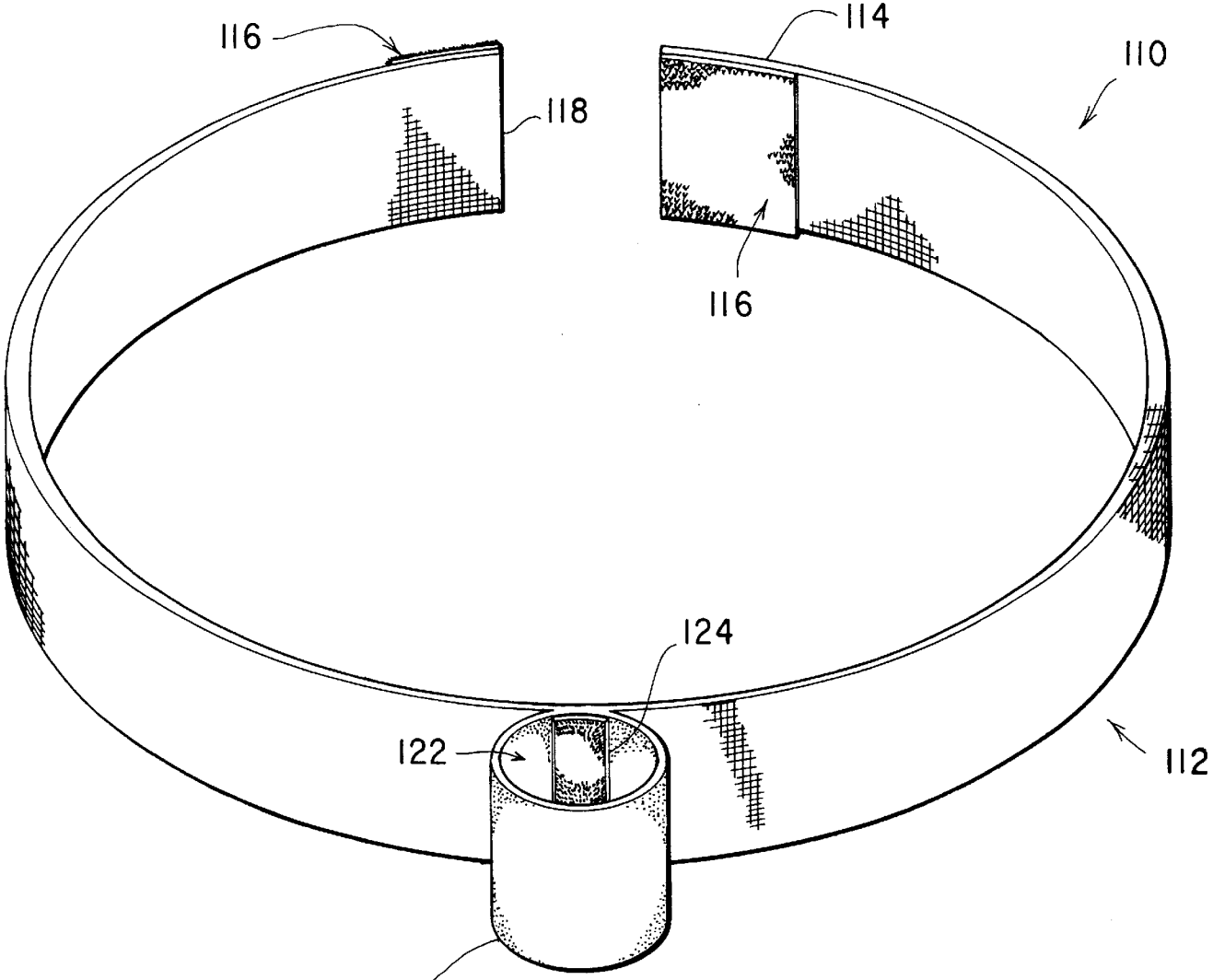
FIG. 6 is a perspective view of a fourth embodiment for the holding element.

FIG. 6 illustrates a fourth embodiment of the holding element 110. A belt 112 having a first end 114 and a second end 118 is used to engage the waist of the person. The belt 112 includes means for securing it around the waist of the person, such as a buckle or corresponding patches 116 of hook and loop fasteners disposed on its first and second ends 114, 118. Various other means for securing the belt 112, such as a clip or pin, may also be provided. A pocket 120 is coupled to the belt 112 at a location near the center point of the belt 112. The pocket 120 is cylindrically shaped and has a hollow interior. Furthermore, an opening 122 is provided at each end of the pocket 120. A patch 124 of hook and loop fastener is disposed on the interior surface of the pocket 120 in order to engage the corresponding patch 22 of hook and loop fastener disposed on the container 14.

Figure 7:
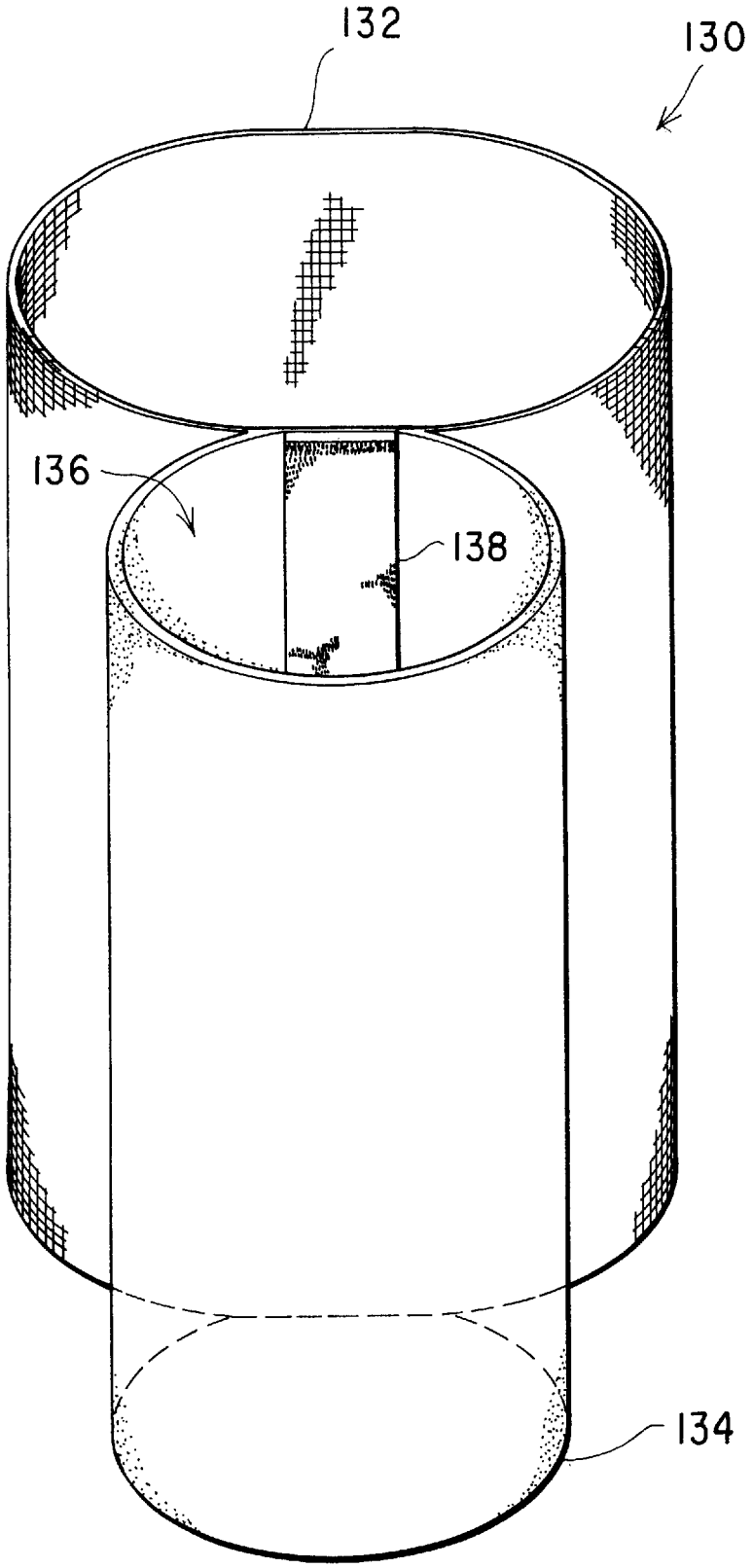
FIG. 7 is a perspective view of a fifth embodiment for the holding element.

FIG. 7 illustrates a fifth embodiment for the holding element 130. The holding element 130 includes a band 132 of resilient material which is designed to receive one of the person's limbs, preferably an arm. A tubular pocket 134 is coupled to the band 130 and functions to retain the container 14. The pocket 134 includes an opening 136 through which the container 14 may be inserted. The pocket 134 may also be provided with openings 136 at each end in order to accommodate longer containers 14. A patch 138 of hook and loop fastener can also be disposed on the interior surface of the pocket 134 in order to engage the corresponding patch 22 of hook and loop fastener on the surface of the container 14.

The beverage dispensing system of the present invention is preferably provided with a container which is in the form of a small lightweight, squeezable bottle. The holding element should also be in the form of lightweight materials, including, but not limited to, cloth, plastic, metal, cardboard, foam or wood, which can be carried or worn on various parts of the body of the user or attached to a base. Similarly, the container can be made of materials including, but not limited to, plastic, metal or foam. The container may also be provided with a removable or nonremovable twist top which can house either a spray, tubestraw, pump, poppet-type valve, or nozzle.

The beverage dispensing system of the present invention allows the container to be carried on one's person with the aid of support materials in such a way as to render it immobile while still being totally synchronized with one's body movements. This is particularly advantageous during outdoor activities such as jogging where fluid replenishment is essential, but the jogger cannot be inconvenienced by carrying various bottles or containers in his/her hands. As seen in the figures, the beverage dispensing system is easily supported by the person, while not being cumbersome.

Some additional advantages of the present invention are as follows: although not shown, the cap holds a locking/unlocking device and has a lip to open and close top; the container is both reusable and recyclable; helps prevent heat exhaustion and dehydration; promotes conservation of water when used in lieu of open-mouthed cups at marathons; round smooth surfaces of container contributes to safe carrying for children; is virtually spillproof; and is environmentally friendly and safe in that no dyes or chemicals are used in making the container.

It is to be understood that the present invention is not limited to the embodiments described above, but encompasses any and all embodiments within the scope of the following claims.

I claim:

1. A beverage dispensing system for transportation on a person's limb, the beverage dispensing system comprising:

a cylindrical container for storing a predetermined quantity of beverage therein, said container including a first component of a fastener attached thereto;

sealing means for sealing said container and allowing the person selectively to replenish said container with said predetermined quantity of beverage; and a flexible band sized for encircling a person's limb, said band having a first corresponding component of a fastener attached thereto, said first corresponding component mating with said first component of the fastener attached to the container;

a belt attached to said band, said belt having a surface and a terminal end, said surface including a second component of a fastener, and said terminal end including a second corresponding component of a fastener; whereby upon wrapping the belt around the container, said second component mates with said second corresponding component of the fastener to secure the container about the person's limb such that said container is simultaneously secured by said first components of fastener and said belt.

2. A beverage dispensing system as recited in claim 1 further comprising:

a straw having a first end disposed within said container and a second end extending through said sealing means for allowing consumption of said predetermined quantity of beverage; and a cap disposed over the second end of said straw for preventing accidental spillage of said predetermined quantity of beverage.

3. A beverage dispensing system as recited in claim 1 wherein said first component and said first corresponding component of the fastener comprise a hook and loop fastener.

4. A beverage dispensing system as recited in claim 1 wherein said second component and said second corresponding component of the fastener comprise a hook and loop fastener.

* * * * *